US010978013B2

(12) United States Patent
Kang

(10) Patent No.: US 10,978,013 B2
(45) Date of Patent: Apr. 13, 2021

(54) METHOD FOR DRIVING LIQUID CRYSTAL DISPLAY APPARATUS

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chih Tsung Kang, Chongqing (CN)

(73) Assignees: HKC CORPORATION LIMITED, Shenzhen Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/040,811

(22) PCT Filed: Nov. 9, 2018

(86) PCT No.: PCT/CN2018/114713
§ 371 (c)(1),
(2) Date: Sep. 23, 2020

(87) PCT Pub. No.: WO2019/184374
PCT Pub. Date: Oct. 3, 2019

(65) Prior Publication Data

US 2021/0012729 A1 Jan. 14, 2021

(30) Foreign Application Priority Data

Mar. 30, 2018 (CN) ..... 201810292584.2

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 3/3413* (2013.01);
(Continued)

(58) Field of Classification Search
None
See application file for complete search history.

(56) References Cited

U.S. PATENT DOCUMENTS

2002/0057253 A1* 5/2002 Lim ..... G09G 3/3611 345/102
2006/0146005 A1* 7/2006 Baba ..... G09G 3/3233 345/102

(Continued)

FOREIGN PATENT DOCUMENTS

CN 102695074 A 9/2012
CN 107799079 A 3/2018

(Continued)

OTHER PUBLICATIONS

International Search Report from International Application No. PCT/CN2018/114713 dated Feb. 11, 2019.

*Primary Examiner* — Chad M Dicke
(74) *Attorney, Agent, or Firm* — Dorsey & Whitney

(57) ABSTRACT

A method for driving a display apparatus. The method comprises: dividing an original gray scale data set of a pixel unit (110) into three grayscale data sets, and then, when the divided grayscale data sets are displayed, turning off backlight units (320), the colors of which are the same and occupy most of the colors corresponding to 0 grayscale data.

20 Claims, 4 Drawing Sheets

(52) U.S. Cl.
CPC ..... *G09G 2320/0242* (2013.01); *G09G 2320/0252* (2013.01); *G09G 2320/0686* (2013.01)

(56) References Cited

U.S. PATENT DOCUMENTS

| | | | | |
|---|---|---|---|---|
| 2014/0300650 | A1* | 10/2014 | Dai | G09G 3/3611 345/690 |
| 2015/0325183 | A1* | 11/2015 | Chen | G09G 5/005 345/694 |
| 2015/0379942 | A1 | 12/2015 | Guo et al. | |
| 2016/0049118 | A1* | 2/2016 | Chen | G09G 3/3696 345/205 |
| 2016/0247427 | A1* | 8/2016 | Fan | G09G 3/006 |
| 2016/0247439 | A1* | 8/2016 | Fan | G09G 3/3413 |
| 2016/0247459 | A1* | 8/2016 | Fan | G09G 3/3413 |
| 2017/0148396 | A1* | 5/2017 | Chen | G09G 3/2003 |
| 2017/0162136 | A1* | 6/2017 | Kang | G09G 3/3607 |
| 2020/0013351 | A1* | 1/2020 | Shan | G09G 3/3607 |
| 2020/0226987 | A1* | 7/2020 | Shan | G09G 5/10 |

FOREIGN PATENT DOCUMENTS

| | | | |
|---|---|---|---|
| CN | 107808648 | A | 3/2018 |
| CN | 108510952 | A | 9/2018 |

* cited by examiner

METHOD FOR DRIVING LIQUID CRYSTAL DISPLAY APPARATUS

TECHNICAL FIELD

This application relates to the field of liquid crystal display technologies, and in particular to a driving method for a liquid crystal display device.

BACKGROUND

For the color shifts at a large viewing angle and a front view angle in various representative color systems of the liquid crystal display, the red, green and blue color systems have more serious color shifts at the large viewing angle than those of other color systems, and due to the rapid saturation increase of the ratio of viewing angle to brightness for gray-scale liquid crystal display, the lower the gray-scale value, the larger the difference between the brightness at the front viewing angle and the brightness at the side viewing angle.

A current method for alleviating the color shift is to subdivide each sub-pixel into one primary pixel and one secondary pixel, which are then driven with a relatively high driving voltage and a relatively low driving voltage respectively to display one sub-pixel together. Furthermore, when the primary and secondary pixels are driven with the relatively high driving voltage and the relatively low driving voltage respectively, a relationship between the brightness at the front viewing angle and the corresponding gray-scale can be kept the same. According to the driving method described, generally, in the first half of the gray-scale, the primary pixels are driven and displayed with the relatively high driving voltage and the secondary pixels are not displayed, so that the brightness of the entire sub-pixels is half that of the primary pixels; and in the second half of the gray-scale, the primary pixels are driven with the relatively high driving voltage for display and the secondary pixels are driven with the relatively low driving voltage for display, so that the brightness of the entire sub-pixels is half the sum of the brightness of the primary pixels and the brightness of the secondary pixels. After combination in such a way, although the color shift at the large viewing angle is somewhat alleviated, the driving method described above has a problem that it is necessary to double the metal wire routing and driving devices to drive the secondary pixels, which affects the light transmittance and aperture ratio of a panel, and additionally increases the production costs.

SUMMARY

In view of this, this application provides a driving method for a liquid crystal display device to resolve the problem of color shift at a large viewing angle without increasing the costs.

This application provides a driving method for a liquid crystal display device, wherein the liquid crystal display device comprises a display module and a backlight module; the display module comprises a plurality of pixel units arranged in an array, and the pixel unit comprises a red sub-pixel, a green sub-pixel and a blue sub-pixel; the pixel units generate a color of any one of three types: a unitary color, a binary mixed color and a ternary mixed color each time; the backlight module is provided with a plurality of backlight units; the backlight unit comprises a red light source, a green light source and a blue light source; the display module is divided into at least two display areas mutually independent; the display area corresponds to at least one of the backlight units, and the backlight units corresponding to different display areas are mutually independent; and the driving method comprises the steps of:

determining a type of a color corresponding to an original gray-scale data group to be displayed by each pixel unit;

dividing the original gray-scale data group into a first gray-scale data group, a second gray-scale data group and a third gray-scale data group according to the type of the color corresponding to the original gray-scale data group to be displayed by each pixel unit on the basis of a set grouping rule;

outputting and displaying the first gray-scale data group, the second gray-scale data group and the third gray-scale data group in three consecutive time periods respectively;

the first gray-scale data group being a ternary mixed color gray-scale data group, a binary mixed color gray-scale data group or a unitary color gray-scale data group; the second gray-scale data group being a binary mixed color gray-scale data group or a unitary color gray-scale data group; and the third gray-scale data group being a unitary color gray-scale data group;

calculating an average gray-scale value of the red sub-pixels, an average gray-scale value of the green sub-pixels and an average gray-scale value of the blue sub-pixels among gray-scale values corresponding to original gray-scale data to be displayed in each display area respectively;

determining the magnitudes of the average gray-scale value of the red sub-pixels, the average gray-scale value of the green sub-pixels and the average gray-scale value of the blue sub-pixels in each display area;

turning off, in a time period in which the second gray-scale data group is displayed, a light source in a backlight unit corresponding to each display area, which light source has a color the same as the color of sub-pixels with a minimum average gray-scale value in the each display area; and turning off, in a time period in which the third gray-scale data group is displayed, a light source in a backlight unit corresponding to each display area, which light source has a color different from that of sub-pixels with a maxminum average gray-scale value in the each display area.

Based on the same inventive conception, this application further provides another driving method for a liquid crystal display device, wherein the liquid crystal display device comprises a display module and a backlight module; the display module comprises a plurality of pixel units arranged in an array, and the pixel unit comprises a red sub-pixel, a green sub-pixel and a blue sub-pixel; the pixel unit generates a color of any one of three types: a unitary color, a binary mixed color and a ternary mixed color each time; the backlight module is provided with a plurality of backlight units; the backlight unit comprises a red light source, a green light source and a blue light source; the display module is divided into at least two display areas mutually independent; the display area corresponds to at least one of the backlight units, and the backlight units corresponding to different display areas are mutually independent; and the driving method comprises the steps of:

determining a type of a color corresponding to an original gray-scale data group to be displayed by the $n^{th}$ pixel unit;

dividing the original gray-scale data group into a first gray-scale data group, a second gray-scale data group and a third gray-scale data group according to the type of the color corresponding to the original gray-scale data group to be displayed by the $n^{th}$ pixel unit on the basis of a set grouping rule;

outputting and displaying the first gray-scale data group, the second gray-scale data group and the third gray-scale data group in three consecutive time periods respectively;

the first gray-scale data group being a ternary mixed color gray-scale data group, a binary mixed color gray-scale data group or a unitary color gray-scale data group; the second gray-scale data group being a binary mixed color gray-scale data group or a unitary color gray-scale data group; and the third gray-scale data group being a unitary color gray-scale data group;

calculating an average gray-scale value of the red sub-pixels, an average gray-scale value of the green sub-pixels and an average gray-scale value of the blue sub-pixels among gray-scale values corresponding to original gray-scale data to be displayed by the $N^{th}$ display area;

determining the magnitudes of the average gray-scale value of the red sub-pixels, the average gray-scale value of the green sub-pixels and the average gray-scale value of the blue sub-pixels in the $N^{th}$ display area;

turning off a light source, having a color the same as the color of the sub-pixels with the minimum average gray-scale value in the $N^{th}$ display area, in the backlight unit corresponding to the $N^{th}$ display area in a time period in which the second gray-scale data group is displayed; and turning off a light source, having a color different from the color of the sub-pixel with the maximum average gray-scale value in the $N^{th}$ display area, in the backlight unit corresponding to the $N^{th}$ display area in a time period in which the third gray-scale data group is displayed.

Both n and N are integers greater than or equal to 1.

Based on the same inventive conception, this application further provides a further driving method for a liquid crystal display device, wherein the liquid crystal display device comprises a display module and a backlight module; the display module comprises a plurality of pixel units arranged in an array, and the pixel unit comprises red sub-pixels, green sub-pixels and blue sub-pixels; the pixel unit generates a color of any one of three types: a unitary color, a binary mixed color and a ternary mixed color each time; the backlight module is provided with a plurality of backlight units; the backlight unit comprises a red light source, a green light source and a blue light source; the display module is divided into at least two display areas mutually independent; the display area corresponds to at least one of the backlight units, and the backlight units corresponding to different display areas are mutually independent; and the driving method comprises the steps of:

calculating an average gray-scale value of the red sub-pixels, an average gray-scale value of the green sub-pixels and an average gray-scale value of the blue sub-pixels among gray-scale values corresponding to original gray-scale data to be displayed by each display area;

determining the magnitudes of the average gray-scale value of the red sub-pixels, the average gray-scale value of the green sub-pixels and the average gray-scale value of the blue sub-pixels in each display area; and determining whether the number of the pixel units displaying the unitary color in the display area reaches a first set value, and if yes, turning off a light source, having a color different from the color of the sub-pixel with the maximum average gray-scale value in the display area, in the backlight unit corresponding to the display area.

According to the driving method for the liquid crystal device as described above, the display module is divided into a plurality of display areas mutually independent and at least one backlight unit corresponding to each display area is disposed on the backlight panel; the backlight unit comprises a red light source, a green light source and a blue light source; the average gray-scale values of the red sub-pixels, the green sub-pixels and the blue sub-pixels among the gray-scale values corresponding to the original gray-scale data to be displayed in the display area are calculated respectively, the magnitudes of the average gray-scale values corresponding to the red sub-pixels, the green sub-pixels and the blue sub-pixels in each display area is judged; when the decomposed gray-scale data groups are controlled to be displayed according to a magnitude relationship among the average gray-scale values of the display area, the backlight unit of the corresponding color with most of the gray-scale values being zero is turned off; and with such a configuration, the brightness ratio of the dominant tone, so that the color shift caused by the fact that the dominant tone at the large viewing angle is affected by the low-voltage sub-pixels is alleviated. The main signal brightness presented at the large viewing angle is increased. Meanwhile, the display brightness for the overall image quality can be maintained by doubling the backlight brightness, and the display speed for the overall image quality can be maintained by doubling the driving frequency. In addition, energy saving can be achieved while alleviating the color shift. Moreover, there is no need of additional wiring or the like on a liquid crystal display panel.

DETAILED DESCRIPTION OF THE EMBODIMENTS

To make the objectives, technical solutions, and advantages of this application clearer and more comprehensible, the following further describes this application in detail with reference to the accompanying drawings and embodiments. It should be understood that the specific embodiments described herein are merely used to explain this application but are not intended to limit this application.

Figure 1:
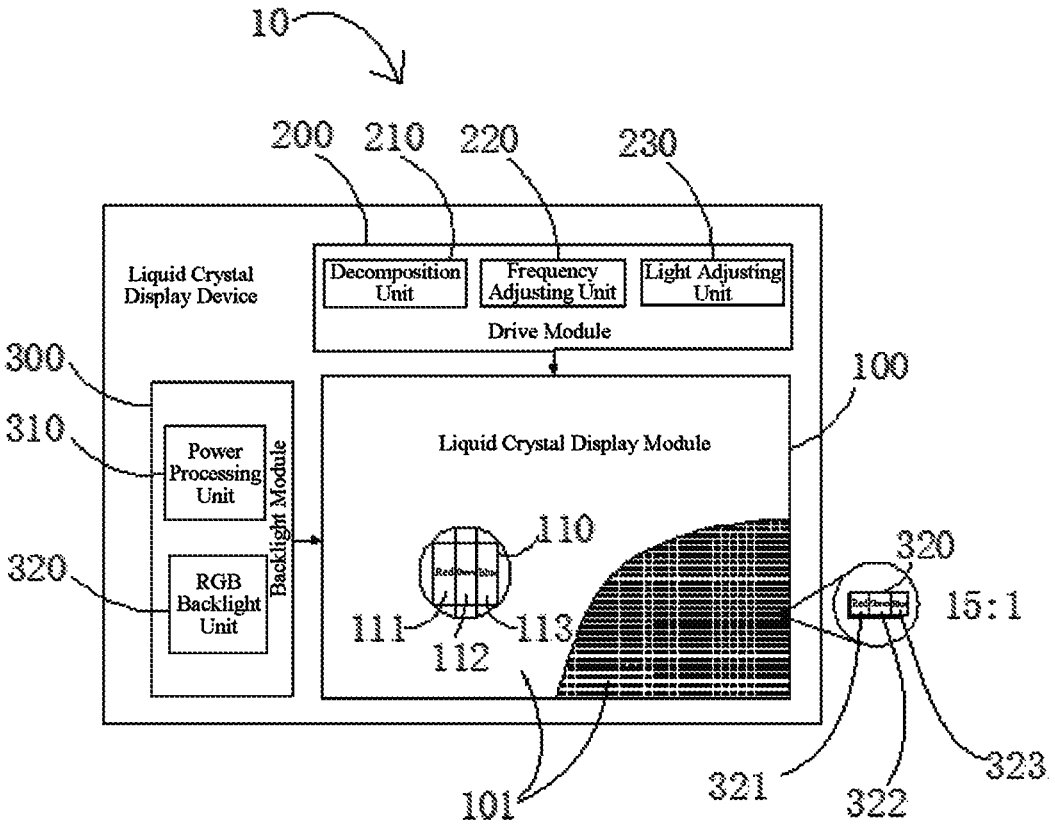
FIG. 1 is a schematic diagram showing modules constitution of a liquid crystal display device.
Figure 2:
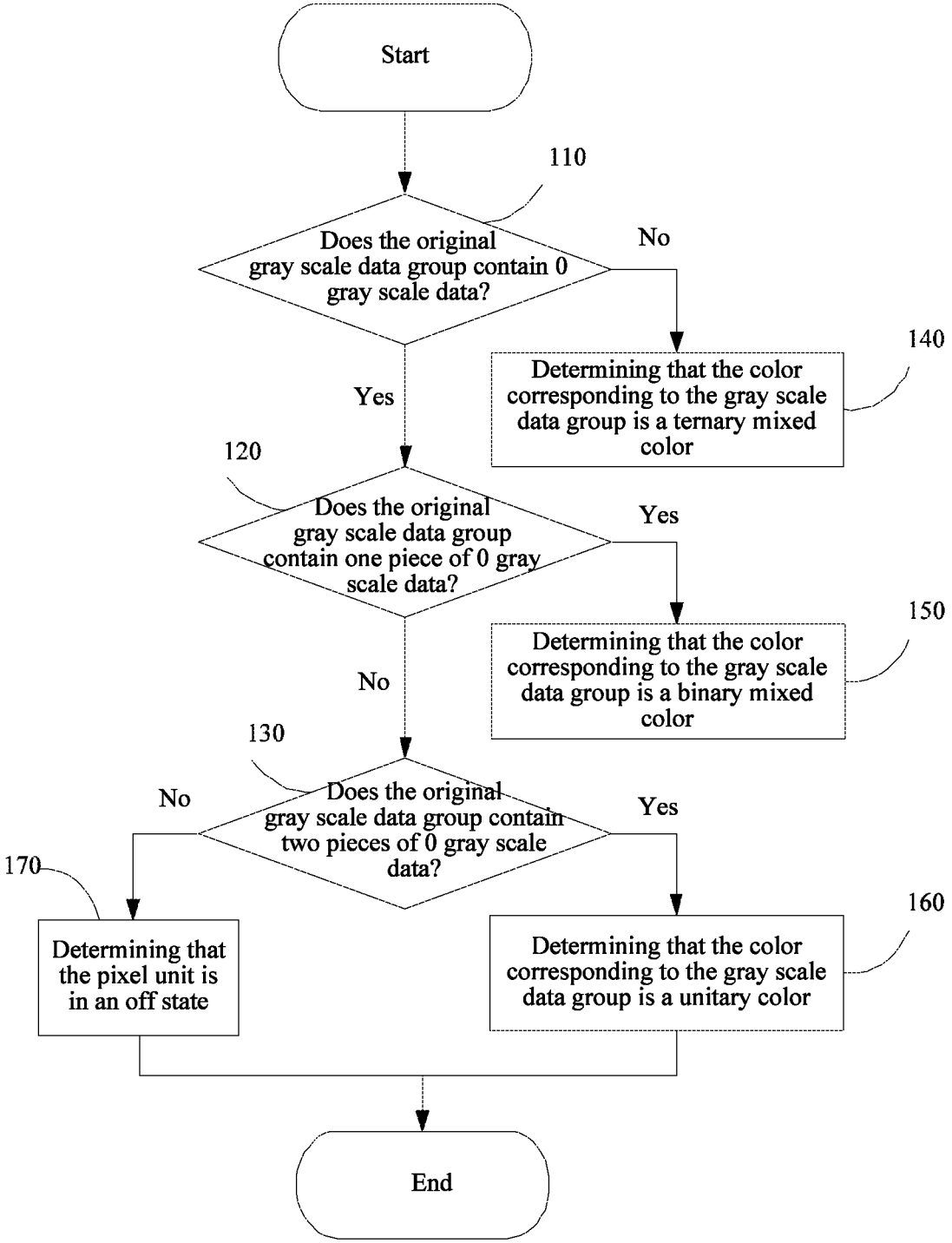
FIG. 2 is a flowchart of a driving method for determining a type of color displayed by a pixel unit corresponding to an original gray-scale data group.

This application provides a driving method for a liquid crystal device. As shown in FIG. 1, the liquid crystal display device includes a display module 100 and a backlight module 300. The display module 100 includes a plurality of pixel units 110 arranged in an array, and the pixel unit 110 includes a red sub-pixel 111, a green sub-pixel 112 and a blue sub-pixel 113. The pixel unit 110 generates a type of color once receiving one gray-scale value. The gray-scale value is generated from gray-scale data input into the display device. A gray-scale group includes a red gray-scale value, a green gray-scale value and a blue gray-scale value. The pixel unit 110 generates a color of any one of three types: a unitary color, a binary mixed color and a ternary mixed color each time. The backlight module 300 includes a power supply processing unit 310 and a backlight unit 320. A drive module 200 includes a gray-scale data decomposition processing unit 210, a driving frequency adjusting unit 220 and a backlight adjusting unit 230. The display module 100 is configured to display graphics and text information. The drive module 200 is configured to receive, processing and outputting driving data to control the display module 100 to work properly. The backlight module 300 is configured to process current and turning on the backlight unit 320. The backlight unit 320 includes a red light source, a green light source and a blue light source. The display module 100 is divided into at least two display areas mutually independent. The display area corresponds to at least one backlight unit 320, and the backlight units 320 corresponding to different display areas are mutually independent. The gray-scale data decomposition processing unit 210 is configured to decompose input original gray-scale data corresponding to each pixel unit 110 into three new gray-scale data groups, and outputting gray-scale values of the red sub-pixel 111, the green sub-pixel 112 and the blue sub-pixel 113 in each pixel unit 110 in three consecutive time periods. The driving frequency adjusting unit 220 is configured to adjust the driving frequency. The backlight adjusting unit 230 is configured to adjust the color and brightness of the backlight units 320. The driving method includes the steps of:

calculating an average gray-scale value of the red sub-pixels 111, an average gray-scale value of the green sub-pixels 112 and an average gray-scale value of the blue sub-pixels 113 among gray-scale values corresponding to original gray-scale data to be displayed in each area respectively; and determining the magnitudes of the average gray-scale value of the red sub-pixels 111, the average gray-scale value of the green sub-pixels 112 and the average gray-scale value of the blue sub-pixels 113 in each display area.

A light source, having a color the same as the color of the sub-pixels with the minimum average gray-scale value in each display area, in the backlight unit 320 corresponding to the display area is turned off in a time period in which the second gray-scale data group is displayed.

A light source, having a color different from the color of the sub-pixel with the maximum average gray-scale value in each display area, in the backlight unit 320 corresponding to the display area is turned off in a time period in which the third gray-scale data group is displayed.

In one embodiment, a type of a color corresponding to an original gray-scale data group to be displayed by each pixel unit 110 is judged. The original gray-scale data group is divided into a first gray-scale data group, a second gray-scale data group and a third gray-scale data group according to the type of the color corresponding to the original gray-scale data group to be displayed in each unit on the basis of a set grouping rule. The first gray-scale data group, the second gray-scale data group and the third gray-scale data group are output and displayed in three consecutive time periods respectively. The first gray-scale data group is a ternary mixed color gray-scale data group, a binary mixed color gray-scale data group or a unitary color gray-scale data group. The second gray-scale data group is a binary mixed color gray-scale data group or a unitary color gray-scale data group. The third gray-scale data group is unitary color gray-scale data group.

Determining a type of a color corresponding to original gray-scale data according to the number of zero gray-scale data in the original gray-scale data group to be displayed by each pixel unit includes:

a color corresponding to the original gray-scale data group is the ternary mixed color when the original gray-scale data group includes no zero gray-scale data;

a color corresponding to the original gray-scale data groups is the binary mixed color when the original gray-scale data group includes one piece of zero gray-scale data.

a color corresponding to the original gray-scale data group is the unitary color when the original gray-scale data group includes two pieces of zero gray-scale data.

Figure 3:
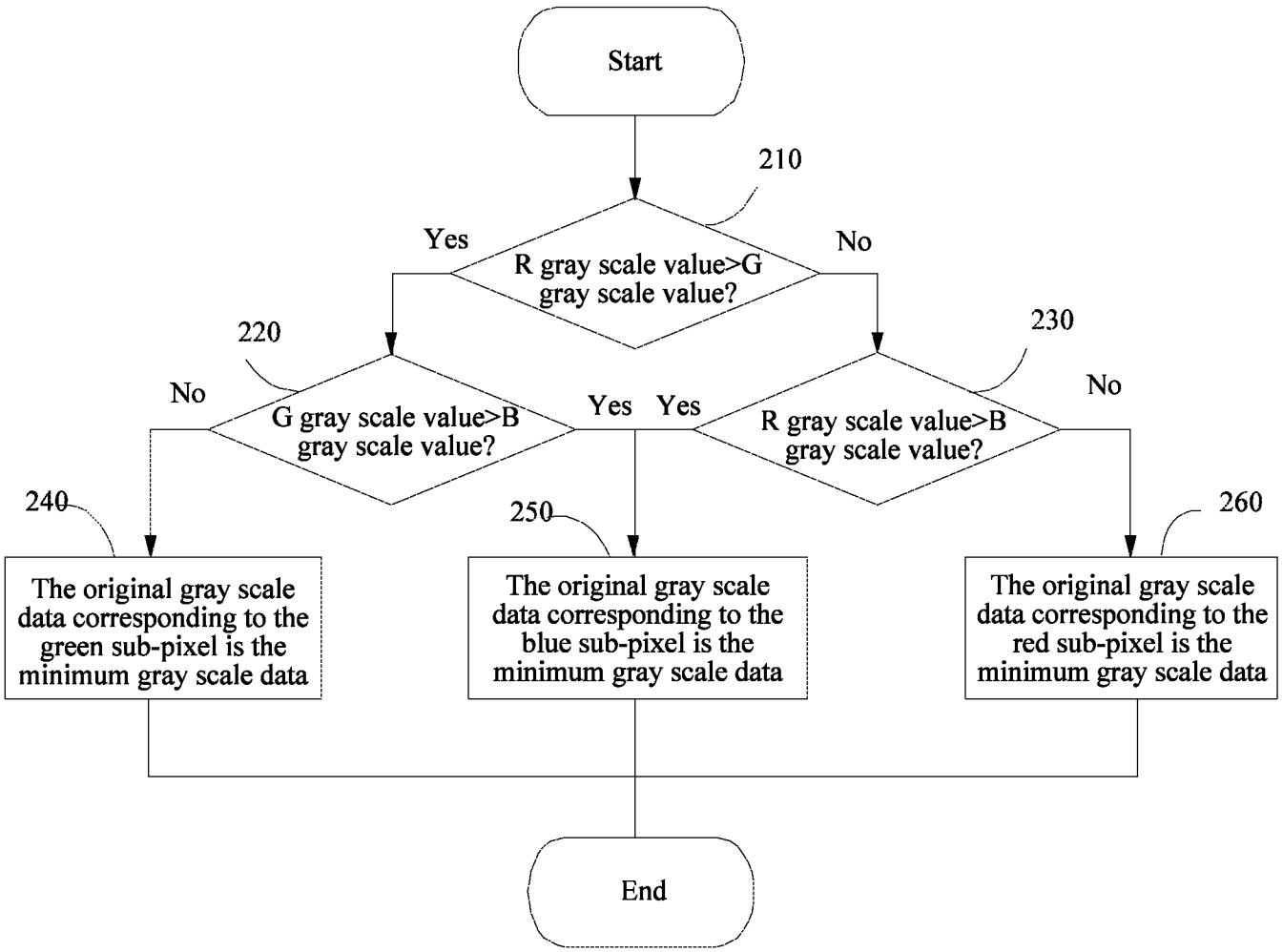
FIG. 3 is a flowchart of a driving method for determining minimum gray-scale data in a ternary mixed color gray-scale data group.

Specifically as shown in FIG. 3, in one embodiment, a method for determining a type of a color corresponding to the original gray-scale data group to be displayed by each pixel unit 110 includes S110 to S170.

Step S110: Judge whether the original gray-scale data group to be displayed by each pixel unit includes zero gray-scale data, if not, perform step S140, otherwise, perform step S120. For a color of a ternary mixed color type, it is indicated that the color includes three color components including red, green and blue; and in the field of liquid crystal display, all the gray-scale values corresponding to the red sub-pixel 111, the green sub-pixel 112 and the blue sub-pixel 113 in the pixel unit are not zero. That is, the corresponding original gray-scale data group includes no zero gray-scale data, therefore, whether the original gray-scale data group is a ternary mixed color gray-scale data group can be judged by determining whether the original gray-scale data group includes the zero gray-scale data.

Step S120: Judge whether the original gray-scale data group to be displayed by each pixel unit includes one piece of zero gray-scale data only, if yes, perform step S150, otherwise, perform step S130. For a color of a binary mixed color type, it is indicated that the color includes any two of the three color components including red, green and blue; and in the field of liquid crystal display, only one of the gray-scale values corresponding to the red sub-pixel 111, the green sub-pixel 112 and the blue sub-pixel 113 in the pixel unit is zero, with the other two being not zero. That is, the corresponding original gray-scale data group only includes one piece of zero gray-scale data, therefore, whether the original gray-scale data group is a binary mixed color gray-scale data group can be judged by determining whether the original gray-scale data group includes one piece of zero gray-scale data only.

Step S130: Judge whether the original gray-scale data group to be displayed by each pixel unit include two pieces of zero gray-scale data only, if yes, perform step S160, otherwise, perform step S170. For a color of a unitary color type, it is indicated that the color only includes any one of the three color components including red, green and blue; and in the field of liquid crystal display, only two of the gray-scale values corresponding to the red sub-pixel 111, the green sub-pixel 112 and the blue sub-pixel 113 in the pixel unit are zero, with the other one being not zero. That is, the corresponding original gray-scale data group only includes two pieces of zero gray-scale data, therefore, whether the original gray-scale data group is a unitary color gray-scale data group can be judged by determining whether the original gray-scale data group includes two pieces of zero gray-scale data only.

Step S140: Determine that the color displayed by the pixel unit corresponding to the gray-scale group is the ternary mixed color.

Step S150: Determine that the color displayed by the pixel unit corresponding to the gray-scale group is the binary mixed color.

Step S160: Determine that the color displayed by the pixel unit corresponding to the gray-scale group is the unitary color.

Step S170: Determine that the pixel unit corresponding to the gray-scale group is in an OFF state. When all the gray-scale values corresponding to each sub-pixel in a pixel unit are zero, it is indicated that the pixel unit does not undertake a display task; and in such case, the voltage of each sub-pixel of the pixel unit is zero and in an OFF state; and since light cannot transmit through the liquid crystal, the pixel unit is black.

In one embodiment, the grouping rule specifically includes:

A first mode: using minimum original gray-scale data in the original gray-scale data group corresponding to the pixel unit 110 of the ternary mixed color as common gray-scale data for the red sub-pixel 111, the green sub-pixel 112 and the blue sub-pixel 113 in the pixel unit to form the first gray-scale data group;

using minimum non-0 gray-scale data in a difference data group obtained by subtracting the first gray-scale data group from the original gray-scale data group corresponding to the pixel unit 110 of the ternary mixed color as common gray-scale data for the sub-pixels corresponding to the non-0 gray-scale data in the difference data group, to form the second gray-scale data group with the zero gray-scale data; and using a difference data group obtained by subtracting the first gray-scale data group and the second gray-scale data group from the original gray-scale data group corresponding to the pixel unit 110 of the ternary mixed color respectively as the third gray-scale data group;

A second mode: using gray-scale data corresponding to half of gray-scale values corresponding to minimum non-0 gray-scale data in the original gray-scale data group corresponding to the pixel unit of the binary mixed color as common gray-scale data for the sub-pixels corresponding to two pieces of non-0 gray-scale data in the pixel unit to form the first gray-scale data group and the second gray-scale data group respectively with the zero gray-scale data; and using a difference data group obtained by subtracting the first gray-scale data group and the second gray-scale data group from the original gray-scale data group corresponding to the pixel unit of the binary mixed color as the third gray-scale data group;

A third mode: using gray-scale data corresponding to one third of gray-scale values corresponding to the non-0 gray-scale data in the original gray-scale data group corresponding to the pixel unit of the unitary color as gray-scale data of the sub-pixel corresponding to the non-0 gray-scale data in the pixel unit to form the first gray-scale data group, the second gray-scale data group and the third gray-scale data group respectively with the zero gray-scale data.

Figure 4:
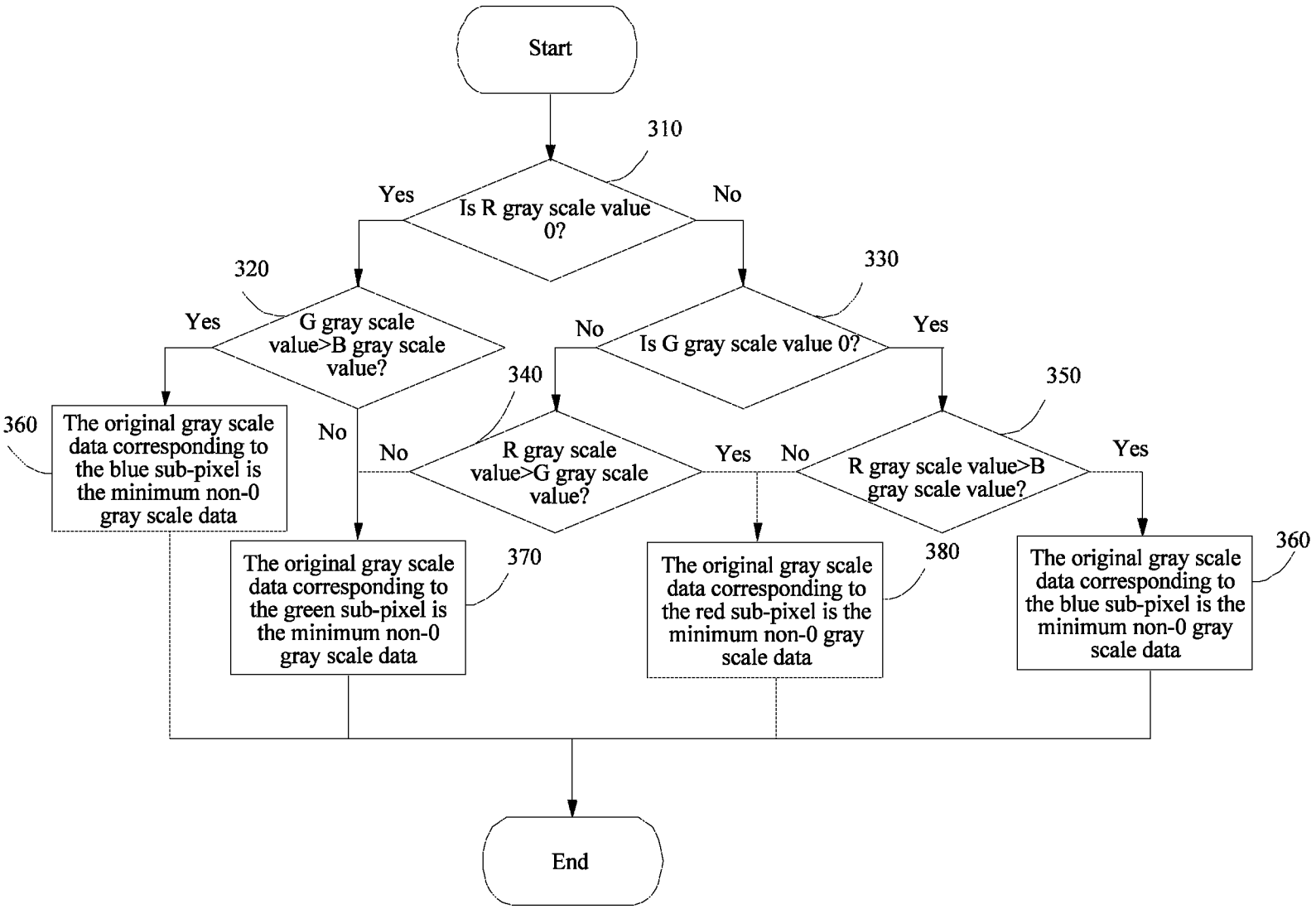
FIG. 4 a flowchart of a driving method for determining minimum non-0 gray-scale data in a binary mixed color gray-scale data group.

An embodiment shown in FIG. 4 provides a method for determining the minimum gray-scale data in thee ternary mixed color gray-scale data group, which specifically includes steps S210 to S260.

Step S210: Judge whether a red gray-scale value in the original gray-scale group corresponding to the original gray-scale data group to be displayed by the pixel unit of the ternary mixed color is greater than the green gray-scale value, if yes, perform step S220, otherwise, perform step S230. In the step S210, determining a magnitude relationship between the gray-scale value corresponding to the red sub-pixel 111 and the gray-scale value of the green sub-pixel 112 at first is merely enumerated for an illustrative purpose, and in fact, the gray values of any two colors of the red sub-pixel, the green sub-pixel and the blue sub-pixel 113 can be used for judgment.

Step S220: Judge whether a green gray-scale value in the original gray-scale group is greater than the blue gray-scale value, if yes, perform step S250, otherwise, perform step S240. In the step S220, a smaller gray-scale value from the step S120 is then compared with the gray-scale value of another color for judgment, and corresponding judgment results and action signals are outputted.

Step S230: Judge whether a red gray-scale value in the original gray-scale group is greater than the blue gray-scale value, if yes, perform step the S250, otherwise, perform the step S260. In the step S230, the smaller gray-scale value from the step S120 is then compared with the gray-scale value of the other color for determining, and corresponding determining results and action signals are outputted.

Step S240: Determine that the gray-scale data corresponding to the green sub-pixel 112 in the original gray-scale data group is the minimum original gray-scale data.

Step S250: Determine that the gray-scale data corresponding to the blue sub-pixels 113 in the original gray-scale data group is the minimum original gray-scale data.

Step S260: Determine that the gray-scale data corresponding to the red sub-pixels 111 in the original gray-scale data group is the minimum original gray-scale data.

An embodiment shown in FIG. 5 provides a method for determining the minimum non-0 gray-scale data in the binary mixed color gray-scale data group, which specifically includes steps S310 to S380.

Step S310: Judge whether the red gray-scale value in the original gray-scale value group corresponding to the original gray-scale data group to be displayed by the pixel unit of the binary mixed color is zero, if yes, perform step S320, otherwise, perform step S330.

For a color of a binary mixed color type, it is indicated that the color includes any two of the three color components including red, green and blue; and in the field of liquid crystal display, only one of the gray-scale values corresponding to the red sub-pixel 111, the green sub-pixel 112 and the blue sub-pixel 113 in the pixel unit is zero, with the other two being not zero. That is, the corresponding original gray-scale data group only includes one piece of zero gray-scale data. In the step S310, determining whether the gray-scale value corresponding to the red sub-pixel 111 is zero at first is merely to enumerate a case for an illustrative purpose, and in fact, the gray-scale value of one color among the red sub-pixel, the green sub-pixel and the blue sub-pixel 113 can be used for judgment at first.

Step S320: Judge whether a green gray-scale value corresponding to the pixel unit with the red sub-pixel 111 having a zero gray-scale value is greater than the blue gray-scale value, if yes, perform step S360, otherwise, perform step S370. At this step, a color displayed by the pixel unit is determined as a mixed color of green and blue when determining that the gray-scale value corresponding to the red sub-pixel 111 is zero, therefore, the minimum non-0 gray-scale data in the original gray-scale data group corresponding to the pixel unit can be determined by determining a magnitude relationship between the green gray-scale value and the blue gray-scale value.

Step S330: Judge whether a green gray-scale value corresponding to the pixel unit with the red sub-pixel 111 having a non-0 gray-scale value is zero, if yes, perform step S350, otherwise, perform step S340. In the step S330, determining whether the gray-scale value corresponding to the green sub-pixel 112 is zero when determining that the gray-scale value corresponding to the red sub-pixel 111 is non-0 is merely to enumerate a case for an illustrative purpose, and in fact, the gray-scale value of the blue sub-pixel 113 can further be used for judgment.

Step S340: Judge whether a red gray-scale value corresponding to the pixel unit with the blue sub-pixel 111 having a zero gray-scale value is greater than the green gray-scale value, if yes, perform the step S380, otherwise, perform the step S370. At this step, a color displayed by the pixel unit is determined as a mixed color of green and red when determining that the gray-scale value corresponding to the blue sub-pixel 113 is zero, therefore, the minimum non-0 gray-scale data in the original gray-scale data group corresponding to the pixel unit can be determined by determining a magnitude relationship between the green gray-scale value and the red gray-scale value.

Step S350: Judge whether a red gray-scale value corresponding to the pixel unit with the green sub-pixel 112 having a zero gray-scale value is greater than the blue gray-scale value, if yes, perform the step S360, otherwise, perform the step S380. At this step, a color displayed by the pixel unit is determined as a mixed color of red and blue when determining that the gray-scale value corresponding to the green sub-pixel 112 is zero, therefore, the minimum non-0 gray-scale data in the original gray-scale data group corresponding to the pixel units can be determined by determining a magnitude relationship between the red gray-scale value and the blue gray-scale value.

Step S360: Determine that the original gray-scale data corresponding to the blue sub-pixel 113 in the original gray-scale data group corresponding to the pixel unit of the binary mixed color is the minimum non-0 gray-scale data.

Step S370: Determine that whether the original gray-scale data corresponding to the green sub-pixel 112 in the original gray-scale data group corresponding to the pixel unit of the binary mixed color is the minimum non-0 gray-scale data.

Step S380: Determine that whether the original gray-scale data corresponding to the red sub-pixel 111 in the original gray-scale data group corresponding to the pixel unit of the binary mixed color is the minimum non-0 gray-scale data.

In the grouping rule, due to the rapid saturation increase of the ratio of viewing angle to brightness for gray-scale liquid crystal display, the lower the gray-scale value, the larger the difference between the brightness at the front viewing angle and the brightness at the side viewing angle. Therefore, the lowest gray-scale data in the original gray-scale data group is put into a single gray-scale data group for display to highlight a dominant color and alleviate the color shift, and the color having no lowest gray-scale data can be displayed in other groups, thereby eliminating the effect of the color of the lowest gray-scale color in the group on the display of the dominant color due to the rapid saturation increase of the gray-scale liquid crystal display. To illustrate the grouping rule more clearly and directly, the grouping is illustrated below with the gray-scale value. It should be noted that a grouping process is data grouping conducted when the original gray-scale data group is processed, and for the sake of convenience and conciseness, the gray-scale value group is used here for illustration.

It is assumed that an original gray-scale data group corresponding to a pixel unit 110 is converted into a original gray-scale value group (A, B, C). That is, a gray-scale value corresponding to the red sub-pixel 111 is B, a gray-scale value corresponding to the green sub-pixel 112 is B, and a gray-scale value corresponding to the blue sub-pixel 113 is C, if A>B>C, it can be determined that the gray-scale value corresponding to the blue sub-pixel 113 is the minimum gray-scale value, that is, the lowest gray-scale value, among the original gray-scale values, and a difference between the brightness at the front viewing angle and the brightness at the side viewing angle at the lowest gray-scale value is the largest. To alleviate the effect of the lowest gray-scale value, the lowest gray-scale value is used as the common gray-scale value for the red sub-pixel 111, the green sub-pixel 112 and the blue sub-pixel 113 to form the first gray-scale value group, that is, (C, C, C). The minimum non-0 gray-scale value in a difference group obtained by subtracting the lowest gray-scale value from the gray-scale values corresponding to the red sub-pixel 111, the green sub-pixel 112 and blue sub-pixel 113 in the original gray-scale data is used as the common gray-scale data for the non-0 gray-scale data in the difference group to form the second gray-scale value group, that is, (B-C, B-C, zero). A difference obtained by subtracting the first gray-scale value group and the second gray-scale value group respectively from the gray-scale values corresponding to the red sub-pixel 111, the green sub-pixel 112 and blue sub-pixel 113 in the original gray-scale data group is used as the third gray-scale value group, that is, (A-B, zero, zero). With the configuration in such a way, the lowest gray-scale value can be removed from the second gray-scale value group and third gray-scale value group, eliminating the effect of the lowest gray-scale value on the color shift at the large viewing angle when the second gray-scale value group and third gray-scale value group are displayed; and for the overall effect of continuously displaying the three gray-scale value groups, as can be known from the change characteristics of the brightness of the unitary color under the condition of a liquid display large viewing angle, a ratio of the sum of the gray-scale values of the dominant color after decomposition to the low gray-scale value is improved; and thus, both the color shift at the side viewing angle and the brightness of the dominant color are alleviated.

In the description above, each of the gray-scale value data groups and the gray-scale value groups is a data group using the pixel unit 110 as the minimum unit, and consisting of the gray-scale data or gray-scale values respectively corresponding to the red sub-pixel 111, the green sub-pixel 112 and the blue sub-pixel 113. The original gray-scale data group is an original gray-scale value data group including red, green and blue gray-scale data, and input into the liquid crystal display device. The original gray-scale value is a gray-scale value group directly converted from the original gray-scale data group and including red, green and blue gray-scale data.

In the grouping rule described above, the original gray-scale data group corresponding to the binary mixed color and the unitary color is decomposed into three gray-scale data groups in order to keep synchronized with the execution and control manner for the gray-scale data group of ternary mixed color, thereby facilitating driving and control.

In addition, the driving method further includes increasing a driving frequency for each pixel unit to 1 to 4 times to compensate for a display speed decreased due to decomposition of the gray-scale value. An original gray-scale value is decomposed into three gray-scale values to be displayed in three consecutive time periods so that the display time of an image is increased to three times. That is, the display speed is reduced to one third, and the driving frequency can be increased to compensate for the display speed decreased due to the decomposition of the gray-scale value.

In one embodiment, the driving frequency for each pixel unit is increased to 3 times to keep the display speed of the pixel unit after the decomposition of the gray-scale value the same as the display speed before the decomposition of the gray-scale value. Such configuration is to keep the smooth image effect after the decomposition of the gray-scale value for display basically the same as the smooth image effect in the original gray-scale data display, and to alleviate the problem of color shift of the liquid crystal display without compromising the original visual effect.

The brightness of a color light source controlled to be in ON state in the backlight unit 320 is increased to 1 to 4 times to compensate for display speed decreased due to the decomposition of the gray-scale value. The process of decomposing the gray-scale value is to decompose the original high gray-scale value into three new low gray-scale values. That is, actually, a set of high-voltage signals is decomposed into three sets low-voltage signals, so that the brightness is decreased. On the other hand, an original gray-scale value is decomposed into three gray-scale values to be displayed in three consecutive time periods, so that the display time of the image is increased to three times, that is, the display speed is decreased to one third. Therefore, it is general to increase the driving frequency to compensate for the display speed which is decreased due to the decomposition of the gray-scale value, but the increase of the driving frequency may further lead to the decrease of the brightness since the actual display time of each gray-scale data group is shorter than that at the original driving frequency. For example, if the original driving frequency is increased to three times, the actual display time for the driving signal is changed to one third of the original driving signal time, resulting in brightness reduction. To compensate for brightness decreased due to the decomposition of the gray-scale value, or the increase of the driving frequency, or the combined action of the decomposition of the gray-scale value and the increase of the driving frequency, the backlight brightness can be increased.

In one embodiment, the brightness of the color light source controlled to be in ON state in the backlight units 320 is increased to 3 times to keep the brightness of the pixel unit after the decomposition of the gray-scale value the same as the brightness before the decomposition of the gray-scale value. Such configuration is to keep the effect after the decomposition of gray-scale value for display basically the same as the effect in the original gray-scale data display, and to alleviate the problem of color shift of the liquid crystal display without compromising the original visual effect.

According to the driving method for the liquid crystal display device described above, the display module 100 is divided into a plurality of display areas mutually independent, and a backlight panel is provided with at least one backlight unit 320 corresponding to each display area. According to the type of the color corresponding to the original gray-scale data group to be displayed by each pixel unit, the original gray-scale data group is decomposed, on the basis of the set grouping rule, into three gray-scale data groups, that is, a first gray-scale data group, a second gray-scale data group and a third gray-scale group, to be displayed in three consecutive time periods respectively. An average gray-scale value of the red sub-pixel 111, an average gray-scale value of the green sub-pixel 112 and an average gray-scale value of the blue sub-pixel 113 among gray-scale values corresponding to original gray-scale data to be displayed in each display area are calculated respectively; and the magnitudes of the average gray-scale values corresponding to the red sub-pixel 111, the green sub-pixel 112 and the blue sub-pixel 113 in each display area is determined. When the decomposed gray-scale data groups are controlled to be displayed according to a magnitude relationship among the average gray-scale values of the display area, the backlight unit 320 of the corresponding color with most of the gray-scale values being zero is turned off. With Such configuration, the brightness ratio of the dominant tone is increased, and the color shift caused by the fact that the dominant tone at the large viewing angle is affected by the low-voltage sub-pixels is alleviated. The main signal brightness presented at the large viewing angle is increased. Meanwhile, the display brightness for the overall image quality can be maintained by doubling the backlight brightness, and the display speed for the overall image quality can be maintained by doubling the driving frequency. In addition, energy saving can be achieved while alleviating the color shift. Moreover, there is no need of additional wiring or the like on a liquid crystal display panel.

This application further provides a driving method for a liquid crystal display device. The driving method can alleviate the color shift with respect to a specific area.

As shown in FIG. 1, the liquid crystal display device includes a display module 100 and a backlight module 300. The display module 100 includes a plurality of pixel units 110 arranged in an array, and the pixel unit 110 includes a red sub-pixel 111, a green sub-pixel 112 and a blue sub-pixel 113. The pixel unit 110 generates a type of color once receiving one gray-scale value. The gray-scale value is generated from gray-scale data input into the display device. A gray-scale group includes a red gray-scale value, a green gray-scale value and a blue gray-scale value. The pixel unit 110 generates a color of any one of three types: a unitary color, a binary mixed color and a ternary mixed color each time. The backlight module 300 includes a power supply processing unit 310 and a backlight unit 320. A drive module 200 includes a gray-scale data decomposition processing unit 210, a driving frequency adjusting unit 220 and a backlight adjusting unit 230. Furthermore, the display module 100 is configured to display graphics and text information. The drive module 200 is configured to receive, processing and outputting driving data to control the display module 100 to work properly. The backlight module 300 is configured to process current and turning on the backlight unit 320. A plurality of backlight units 320 are used. The backlight unit 320 includes a red light source, a green light source and a blue light source. The display module 100 is divided into at least two display areas mutually independent. The display area corresponds to at least one backlight unit 320, and the backlight units 320 corresponding to the different display areas are mutually independent. The gray-scale data decomposition processing unit 210 is configured to decompose input original gray-scale data corresponding to each pixel unit 110 into three new gray-scale data groups, and outputting gray-scale values of the red sub-pixel 111, the green sub-pixel 112 and the blue sub-pixel 113 in each pixel unit 110 in three consecutive time periods. The driving frequency adjusting unit 220 is configured to adjust the driving frequency. The backlight adjusting unit 230 is configured to adjust the color and brightness of the backlight unit 320.

The driving method includes the steps of:

calculating an average gray-scale value of the red sub-pixels 111, an average gray-scale value of the green sub-pixels 112 and an average gray-scale value of the blue sub-pixels 113 among gray-scale values corresponding to original gray-scale data to be displayed in the $N^{th}$ display area;

determining the magnitudes of the average gray-scale value of the red sub-pixels 111, the average gray-scale value of the green sub-pixels 112 and the average gray-scale value of the blue sub-pixels 113 in the $N^{th}$ display area;

turning off a light source, having a color the same as the color of the sub-pixels with the minimum average gray-scale value in the $N^{th}$ display area, in the backlight unit 320 corresponding to the $N^{th}$ display area in a time period in which the second gray-scale data group is displayed; and turning off a light source, having a color different from the color of the sub-pixel with the maximum average gray-scale value in the $N^{th}$ display area, in the backlight unit 320 corresponding to the $N^{th}$ display area in a time period in which the third gray-scale data group is displayed.

N is an integer greater than or equal to 1.

In one embodiment, the driving method further includes the steps of:

determining a type of a color corresponding to the original gray-scale data according to the number of zero gray-scale data in the original gray-scale data group to be displayed in the $n^{th}$ pixel unit 110;

determining that a color corresponding to the original gray-scale data group is the ternary mixed color when the original gray-scale data group includes no zero gray-scale data;

determining that a color corresponding to the original gray-scale data group is the binary mixed color when the original gray-scale data group includes one piece of zero gray-scale data; and determining that a color corresponding to the original gray-scale data group is the unitary color when the original gray-scale data group includes two pieces of zero gray-scale data.

n is an integer greater than or equal to 1.

In one embodiment, the driving method further includes the step of: dividing the original gray-scale data group into the first gray-scale data group, the second gray-scale data group and the third gray-scale data group according to the type of the color corresponding to the original gray-scale data group to be displayed in the $n^{th}$ pixel unit 110 on the basis of a set grouping rule; and outputting and displaying the first gray-scale data group, the second gray-scale data group and the third gray-scale data group in three consecutive time periods respectively.

n is an integer greater than or equal to 1.

In one embodiment, the first gray-scale data group is a ternary mixed color gray-scale data group, a binary mixed color gray-scale data group or a unitary color gray-scale data group.

The second gray-scale data group is a binary mixed color gray-scale data group or a unitary color gray-scale data group.

The third gray-scale data group is unitary color gray-scale data group.

According to the driving method for the liquid crystal display device described above, the display module 100 is divided into a plurality of display areas mutually independent, and a backlight panel is provided with at least one backlight unit 320 corresponding to each display area. The backlight unit 320 includes a red light source, a green light source and a blue light source; and according to the type of the color corresponding to the original gray-scale data group to be displayed by each pixel unit, the original gray-scale data group is decomposed, on the basis of the set grouping rule, into three gray-scale data groups, that is, a first gray-scale data group, a second gray-scale data group and a third gray-scale group, to be displayed in three consecutive time periods respectively. An average gray-scale value of the red sub-pixels 111, an average gray-scale value of the green sub-pixels 112 and an average gray-scale value of the blue sub-pixels 113 among the gray-scale values corresponding to the original gray-scale data to be displayed in the $N^{th}$ display area are calculated respectively; and the magnitudes of the average gray-scale values of the red sub-pixels 111, the green sub-pixels 112 and the blue sub-pixels 113 in the $N^{th}$ display area are determined respectively. When the decomposed gray-scale data groups are controlled to be displayed according to a magnitude relationship among the average gray-scale values of the display areas, the backlight unit 320 of the corresponding color with most of the gray-scale values being zero is turned off. With such configuration, the brightness ratio of the dominant tone is increased for the specific display area, and the color shift caused by the fact the dominant tone at the large viewing angle is affected by the low-voltage sub-pixels is alleviated. The main signal brightness presented at the large viewing angle is increased for the specific display area. Meanwhile, the display brightness for the overall image quality can be maintained for the specific display area by doubling the backlight brightness, and the display speed for the overall image quality can be maintained for the specific display area by doubling the driving frequency. In addition, energy saving can be achieved while alleviating the color shift for the specific display area. Moreover, there is no need of additional wiring or the like on a liquid crystal display panel.

This application further provides another driving method for a liquid crystal display device. The liquid crystal display device includes a display module 100 and a backlight module 300. The display module 100 includes a plurality of pixel units 110 arranged in an array, and the pixel unit 110 include a red sub-pixel 111, a green sub-pixel 112 and a blue sub-pixel 113. The pixel unit 110 generates a color of any one of three types: a unitary color, a binary mixed color and a ternary mixed color each time. The backlight module 300 is provided with a plurality of backlight units 320. The backlight unit 320 includes a red light source, a green light source and a blue light source. The display module 100 is divided into at least two display areas mutually independent. The display area corresponds to at least one backlight unit 320, and the backlight units 320 corresponding to the different display areas are mutually independent. The driving method includes the steps of:

calculating an average gray-scale value of the red sub-pixels 111, an average gray-scale value of the green sub-pixels 112 and an average gray-scale value of the blue sub-pixels 113 among gray-scale values corresponding to original gray-scale data to be displayed in each display area;

determining the magnitudes of the average gray-scale value of the red sub-pixels 111, the average gray-scale value of the green sub-pixels 112 and the average gray-scale value of the blue sub-pixels 113 in each display area; and determining whether the number of the pixel units displaying the unitary color in the display area reaches a first set value, and if yes, turning off a light source, having a color different from the color of the sub-pixel with the maximum average gray-scale value in the $N^{th}$ display area, in the backlight unit 320 corresponding to the display area.

When the display areas in the display module 100 are divided physically, each of the display areas are stationary and mutually independent. Patterns displayed by each of the display areas are different according to the overall need, some display areas only display one type of color, and some display areas display two and more types of colors. Alternatively, fundamentally, some display areas display the unitary color only, or the binary mixed color only, or the ternary mixed color only, and some display areas can display a combination of any two or three of the unitary color, the binary mixed color or the ternary mixed color. In some display areas, although the pixel units 110 of a mixed color type are fewer at a certain display stage, when the pixel units 110 are concentrated in a pixel block of a certain range. If a light source of the color corresponding to the minimum average gray-scale value in the backlight unit 320 corresponding to the display area is turned off based on a general control method, or if the gray-scale value of the color corresponding to the minimum average gray-scale value in the display area is set to be zero, the image quality may be affected, and even the image integrity may be affected. Therefore, it is also necessary to conduct finer control over such a case when the overall control is planned. Moreover, when the number of the pixel units 110 displaying the unitary color in the display area reaches a first set value, a light source, having a color different from the color of the sub-pixel with the maximum average gray-scale value in the display area, in the backlight unit 320 corresponding to the display area is turned off. "When the number of the pixel units 110 displaying the unitary color in the display area reaches a first set value" indicates that the pixel units of unitary color in a display area accounts for the majority; in such case, the property of the display area is dominated mainly by the unitary color; and controlling a light source, having a color different from the color of the sub-pixels with the maximum average gray-scale value in the display area, in the backlight unit 320 corresponding to the display area to be turned off or on can change an image displayed in the display area or has negligible effect on the image displayed in the display area.

In one embodiment, the driving method further includes the steps of: determining whether a pixel block in which the number of the pixel units 110 displaying the unitary color reaching a second set value exists in the display area, and if yes, maintaining a light source, having a color different from the color of the sub-pixel with the maximum average gray-scale value in the display area, in the backlight unit 320 corresponding to the $N^{th}$ display area turned on; otherwise, turning off the light source, having the color different from the color of the sub-pixel with the maximum average gray-scale value in the display area, in the backlight unit 320 corresponding to the $N^{th}$ display area. In the embodiment, "determining whether a pixel block in which the number of the pixel units 110 displaying the unitary color reaching a second set value exists in the display area" indicates that although a unitary color accounts for a very small part of the pixel units in the total display area, the unitary color is concentrated in a pixel block rather than being scattered in the whole display area. An image displayed in the display area may be affected when the number of the pixel units of unitary color reaches a set value. That is, there may be a case that with respect to the total display area, a color may have the minimum average gray-scale value, which however may not be the minimum with respect to a pixel block in the display area, resulting in that the effect of the color on the pixel block cannot be ignored, then the light source of the color corresponding to the minimum average gray-scale value in the backlight unit 320 corresponding to the display area needs to be maintained to be in ON state in a time period in which the gray-scale data group is displayed, instead of turning off the light source of the color corresponding to the minimum average gray-scale value in the backlight unit 320 corresponding to the display area as usual. Otherwise, the image quality or the image integrity may be affected. For example, a display area is further divided into a first pixel block, a second pixel block, and a third pixel block, which display a red unitary color, a green unitary color and a blue unitary color respectively, the area of the first pixel block is greater than that of the second area, and the area of the second area is greater than that of the third pixel block. In such case, for the total display area, the average gray-scale value of the blue sub-pixels 113 is the minimum, but for the third pixel block where the blue sub-pixels 113 are dominant, if a light source of the color corresponding to the blue sub-pixels 113 having the minimum average gray-scale value in the display area is turned off, the third pixel block may not be displayed, which may seriously affect the originally displayed image.

In some embodiments, the driving method further includes the step of:

determining whether the number of the pixel units 110 displaying the binary mixed color in the display area reaches a third set value, and if yes, turning off a light source, having the same color as the color of the sub-pixels with the minimum average gray-scale value in the display area, in the backlight unit 320 corresponding to the display area. When the number of the pixel units 110 displaying the binary mixed color in the display area reaches a third set value, the light source, having the color from the same as the color of the sub-pixels with the minimum average gray-scale value in the display area, in the backlight unit 320 corresponding to the display area is turned off. "The number of the pixel units 110 displaying the binary mixed color in the display area reaches a third set value" indicates that the pixel units of the binary mixed color in a display area accounts for the majority; in such case, the characteristics of the display area dominated mainly by the binary mixed color; and controlling the light source, having the color the same as the color of the sub-pixels with the minimum average gray-scale value in the display area, in the backlight unit 320 corresponding to the display area to be turned off or on can change the image displayed in the display area or has negligible effect on the image displayed in the display area. Energy saving can be achieved while guaranteeing that the original image is less affected.

According to the driving method for the liquid crystal display device described above, the display module 100 is divided into a plurality of display areas mutually independent, and a backlight panel 300 is provided with at least one backlight unit 320 corresponding to each display area. An average gray-scale value of the red sub-pixels 111, an average gray-scale value of the green sub-pixels 112 and an average gray-scale value of the blue sub-pixels 113 among gray-scale values corresponding to original gray-scale data to be displayed in each display area are calculated respectively; and the magnitudes of the average gray-scale values corresponding to the red sub-pixels 111, the green sub-pixels 112 and the blue sub-pixels 113 in each display area are judged respectively. According to a magnitude relationship among the average gray-scale values of the display area, the backlight unit 320 of the corresponding color with most of the gray-scale values being zero are turned off when the decomposed gray-scale data groups are controlled to be displayed. With such configuration, the brightness ratio of the dominant tone is increased, the color shift caused by the fact that the dominant tone at the large viewing angle is affected by the low-voltage sub-pixels is alleviated. The main signal brightness presented at the large viewing angle is increased. Meanwhile, the display brightness for the overall image quality can be maintained by doubling the backlight brightness, and the display speed for the overall image quality can be maintained by doubling the driving frequency. In addition, energy saving can be achieved while alleviating the color shift. Moreover, there is no need of additional wiring or the like on a liquid crystal display panel.

This application further provides a further driving method for a liquid crystal device. As shown in FIG. 1, the liquid crystal display device includes a display module 100 for displaying graphics and text information. The display module includes a plurality of pixel units 110 arranged in an array. The pixel units include a red sub-pixel 111, a green sub-pixel 112 and a blue sub-pixel 113. The display module 100 is divided into at least two display areas mutually independent. Moreover, the backlight module 300 is provided with a plurality of backlight units 320. The backlight unit 320 includes a red light source, a green light source and a blue light source. The driving method includes the steps of:

calculating an average gray-scale value of the red sub-pixels, an average gray-scale value of the green sub-pixels and an average gray-scale value of the blue sub-pixels among gray-scale values corresponding to original gray-scale data to be displayed in each display area respectively; and determining the magnitudes of the average gray-scale values corresponding to the red sub-pixels, the green sub-pixels and the blue sub-pixels; and turning off a light source, having a color the same as the color of the sub-pixels with the minimum average gray-scale value in each display area, in the backlight unit corresponding to each display area in a time period in which the second gray-scale data group is displayed.

In one embodiment, the driving method further includes the step of: determining a type of a color corresponding to the original gray-scale data group to be displayed in each pixel unit 110.

The original gray-scale data group is divided into the first gray-scale data group, the second gray-scale data group and the third gray-scale data group, which are outputted and displayed in three consecutive time periods respectively, according to the type of the color corresponding to the original gray-scale data group to be displayed in each pixel unit on the basis of the set grouping rule.

The first gray-scale data group is a ternary mixed color gray-scale data group, a binary mixed color gray-scale data group or a unitary color gray-scale data group.

The second gray-scale data group is a binary mixed color gray-scale data group or a unitary color gray-scale data group.

The grouping rule specifically includes the following.

The minimum original gray-scale data in the original gray-scale data group corresponding to the pixel unit 110 of the ternary mixed color is used as common gray-scale data for the red sub-pixels 111, the green sub-pixels 112 and the blue sub-pixels 113 in the pixel units to form the first gray-scale data group.

A difference data group obtained by subtracting the first gray-scale data group from the original gray-scale data group corresponding to the pixel unit 110 of the ternary mixed color is used as the second gray-scale data group.

The zero gray-scale data in the original gray-scale data group corresponding to the pixel unit 110 of the binary mixed color is used as common gray-scale data for the red sub-pixels 111, the green sub-pixels 112 and the blue sub-pixels 113 in the pixel units to form the first gray-scale data group.

The original gray-scale data group corresponding to the pixel unit 110 of the binary mixed color is used as the second gray-scale data group.

Alternatively, the minimum non-0 gray-scale data in the original gray-scale data groups corresponding to the pixel unit of the binary mixed color is used as common gray-scale data for the sub-pixels corresponding to two pieces of non-0 gray-scale data in the pixel unit, to form the first gray-scale data group with the zero gray-scale data; and a difference data group obtained by subtracting the the first gray-scale data group from the original gray-scale data group is used as the second gray-scale data group.

Any one piece of zero gray-scale data in the original gray-scale data group corresponding to the pixel unit 110 of the unitary color is used as common gray-scale data for the red sub-pixels 111, the green sub-pixels 112 and the blue sub-pixels 113 in the pixel unit, to form the first gray-scale data group; and the original gray-scale data group is used as the second gray-scale data group.

Alternatively, gray-scale data corresponding to half of gray-scale values corresponding to non-0 gray-scale data in the original gray-scale data group corresponding to the pixel unit of the unitary color is used as gray-scale data for the sub-pixels corresponding to the non-0 gray-scale data in the pixel unit, to form the first gray-scale data group and the second gray-scale data group respectively with the zero gray-scale data.

It is assumed that an original gray-scale data group corresponding to a pixel unit 110 is converted into an original gray-scale value group (A, B, C) That is, a gray-scale value corresponding to the red sub-pixels 111 is A, a gray-scale value corresponding to the green sub-pixels 112 is B, and a gray-scale value corresponding to the blue sub-pixel 113 is C, if A>B>C, it can be determined that the gray-scale value corresponding to the blue sub-pixels 113 is the minimum gray-scale value, that is, the lowest gray-scale value, among the original gray-scale values, and a difference between the brightness at the front viewing angle and the brightness at the side viewing angle at the lowest gray-scale value is the largest. To alleviate the effect of the lowest gray-scale value, the lowest gray-scale value is used as the common gray-scale value for the red sub-pixels 111, the green sub-pixels 112 and the blue sub-pixels 113 to form the first gray-scale value group, that is, (C, C, C). A difference group obtained by subtracting the minimum gray-scale value from the gray-scale values corresponding to the red sub-pixels 111, the green sub-pixels 112 and blue sub-pixels 113 respectively in the original gray-scale data group is used as the second gray-scale value group, that is, (A-B, B-C, zero). With such configuration, the lowest gray-scale value can be removed from the second gray-scale value group, eliminating the effect of the lowest gray-scale value on the color shift at the large viewing angle when the second gray-scale value group is displayed. The ratio of the sum of the decomposed gray-scale values of the dominant color to the low gray-scale value is increased, therefore, both the color shift at the side viewing angle and the brightness of the dominant color are alleviated.

In the description above, each of the gray-scale value data group and the gray-scale value group is a data group using the pixel unit 110 as the minimum unit, and consisting of the gray-scale data or gray-scale values respectively corresponding to the red sub-pixel 111, the green sub-pixel 112 and the blue sub-pixel 113. The original gray-scale data group is an original gray-scale value data group including red, green and blue gray-scale data, and input into the display device. The original gray-scale value is a gray-scale value group directly converted from the original gray-scale data group and including red, green and blue gray-scale data.

In the grouping rule described above, the original gray-scale data group corresponding to the binary mixed color and the unitary color is decomposed into three gray-scale data groups in order to keep synchronized with the execution and control manner for the gray-scale data group of the ternary mixed color, facilitating driving and control.

In addition, the driving method further includes the step of increasing a driving frequency for each pixel unit to 1 to 3 times to compensate for a display speed decreased due to decomposition of the gray-scale value. An original gray-scale value is decomposed into two gray-scale values to be displayed in two consecutive time periods so that the display time of an image is doubled. That is, the display speed is reduced by half, and the driving frequency can be increased to compensate for the display speed decreased due to the decomposition of the gray-scale value.

In one embodiment, the driving frequency for the each pixel unit is doubled to keep the display speed of the pixel unit after the decomposition of the gray-scale value the same as the display speed before the decomposition of the gray-scale value. Such configuration is to keep the smooth image effect after the decomposition of the gray-scale value for display basically the same as the smooth image effect in the original gray-scale data display, and to alleviate the problem of color shift of the liquid crystal display without compromising the original visual effect.

The driving method further includes the step of increasing brightness of a color light source controlled to be in ON state in the backlight unit to 1 to 3 times to compensate for display brightness deceased due to the decomposition of the gray-scale value, or the increase of the driving frequency, or the combined action of the decomposition of the gray-scale value and the increase of the driving frequency. The process of decomposing the gray-scale value is to decompose the original high gray-scale value into two new low gray-scale values. That is, actually, a set of high-voltage signals is decomposed into two sets of low-voltage signals, so that the brightness is decreased. On the other hand, an original gray-scale value is decomposed into two gray-scale values to be displayed in two consecutive time periods, so that the display time of the image is doubled, that is, the display speed is decreased by half. Therefore, it is general to increase the driving frequency to compensate for the display speed which is decreased due to the decomposition of the gray-scale value, but the increase of the driving frequency may further lead to the decrease of the brightness since the actual display time of each gray-scale data group is shorter than that at the original driving frequency. For example, if the original driving frequency is doubled, the actual display time for the driving signal may be changed to half of the original driving signal time, resulting in brightness reduction. To compensate for brightness deceased due to the decomposition of the gray-scale value, or the increase of the driving frequency, or the combined action of the decomposition of the gray-scale value and the increase of the driving frequency, the backlight brightness can be increased.

In one embodiment, the brightness of a color light source controlled to be in ON state in the backlight unit is doubled to keep the brightness of the pixel unit after the decomposition of the gray-scale value the same as the brightness before the decomposition of the gray-scale value. Such configuration is to keep the effect after the decomposition of gray-scale value for display basically the same as the effect in the original gray-scale data display, and to alleviate the problem of color shift of the liquid crystal display without compromising the original visual effect.

According to the liquid crystal display device and the driving method thereof as described above, the display module is divided into a plurality of display areas mutually independent, and a backlight panel is provided with at least one backlight unit 320 corresponding to each display area. The backlight unit 320 includes a red light source, a green light source and a blue light source. According to the type of the color corresponding to the original gray-scale data group to be displayed by each pixel unit, the original gray-scale data group is decomposed, on the basis of the set grouping rule, into a first gray-scale data group and a second gray-scale data group, to be displayed in two consecutive time periods respectively. An average gray-scale value of the red sub-pixels, an average gray-scale value of the green sub-pixels and an average gray-scale value of the blue sub-pixels among gray-scale values corresponding to original gray-scale data to be displayed in each display area are calculated respectively; and the magnitudes of the average gray-scale values corresponding to the red sub-pixels, the green sub-pixels and the blue sub-pixels are judged respectively. When the decomposed gray-scale data groups are controlled to be displayed according to a magnitude relationship among the average gray-scale values of the display area, the backlight unit of the corresponding color with most of the gray-scale values being zero is turned off. With such configuration, the brightness ratio of the dominant tone is increased, and the color shift caused by the fact that the dominant tone at the large viewing angle is affected by the low-voltage sub-pixels is alleviated. Meanwhile, the main signal brightness presented at the large viewing angle is increased. Moreover, the display brightness for the overall image quality can be maintained by doubling the backlight brightness, and the display speed for the overall image quality can be maintained by doubling the driving frequency. In addition, this application not only can save the energy while alleviating the color shift, but further eliminates the needs of additional wiring on the liquid crystal display panel.

This application further provides a yet another driving method for a liquid crystal device. The liquid crystal display device includes a display module 100. The display module includes a plurality of pixel units 110 arranged in an array. The pixel unit includes a red sub-pixel 111, a green sub-pixel 112 and a blue sub-pixel 113. The display module 100 is divided into at least two display areas mutually independent. The backlight module 300 is provided with a plurality of backlight units 320. The display area corresponds to at least one backlight unit 320. The backlight unit 320 includes a red light source, a green light source and a blue light source. The driving method includes the steps of:

calculating average gray-scale values of the red sub-pixels, the green sub-pixels and the blue sub-pixels among gray-scale values corresponding to original gray-scale data to be displayed in the $N^{th}$ display area;

determining the magnitudes of the average gray-scale values of the red sub-pixels, the green sub-pixels and the blue sub-pixels in the $N^{th}$ display area (refer to steps S210 to S260 above for the method or steps for determining the magnitudes of the average gray-scale values corresponding to the red sub-pixels, the green sub-pixels and the blue sub-pixels of the $N^{th}$ display area); and turning off a light source, having a color the same as the color of the sub-pixels with the minimum average gray-scale value in each display area, in the backlight unit 320 corresponding to the $N^{th}$ display area in a time period in which the second gray-scale data group is displayed.

Both n and N are integers greater than or equal to 1.

In one embodiment, the method further includes: determining a type of a color corresponding to the original gray-scale data group to be displayed in the $n^{th}$ pixel unit 110. The method or steps for judgment is/are the same as steps S110 to S170.

The original gray-scale data group is divided into the first gray-scale data group and the second gray-scale data group according to the type of the color corresponding to the original gray-scale data group to be displayed in the $n^{th}$ pixel unit on the basis of a set grouping rule. The grouping rule here is the same as the "grouping rule" described above.

The first gray-scale data group and the second gray-scale data group are output and displayed in two consecutive time periods respectively.

The first gray-scale data group is a ternary mixed color gray-scale data group, a binary mixed color gray-scale data group or a unitary color gray-scale data group.

The second gray-scale data group is a binary mixed color gray-scale data group or a unitary color gray-scale data group.

The liquid crystal display device may have the following feature.

The liquid crystal display device includes a display module 100 configured to display graphics and text information, where the display module includes a plurality of pixel units 110 arranged in an array, the pixel unit includes a red sub-pixel 111, a green sub-pixel 112 and a blue sub-pixel 113, and the display module 100 is divided into at least two display areas mutually independent; a drive module 200 configured to receive, processing and outputting driving data to control the display module to work properly, where the drive module 200 includes a gray-scale data decomposition processing unit 210, and the gray-scale value decomposition processing unit 210 is configured to decompose the original gray-scale data group to be displayed into a first gray-scale data group and a second gray-scale data group, and outputting gray-scale values corresponding to the first gray-scale data group and the second gray-scale data group respectively in two consecutive time periods; a backlight module 300 provided with a plurality of backlight units 320, where the backlight unit 320 includes a red light source, a green light source and a blue light source, the display area corresponds to at least one backlight unit 320, and the backlight units 320 corresponding to the different display areas are mutually independent.

The driving method for the liquid crystal display device as described above enables the liquid crystal display device to apply the driving method above specific to a set area, or specific to part of the area according to the property of the displayed data. With such configuration, the brightness ratio of the dominant tone can be increased for the liquid crystal display area making use of the driving method above, so that the color shift caused by the fact that the dominant tone at the large viewing angle is affected by the low-voltage sub-pixels is alleviated. In addition, the main signal brightness presented at the large viewing angle can be increased for the liquid crystal display area making use of the driving method above, moreover, the display brightness for the overall image quality can be maintained by doubling the backlight brightness, and the display speed for the overall image quality can be maintained by doubling the driving frequency. Meanwhile, there is no need of additional wiring on a liquid crystal display panel in this application.

In addition, this application further provides a liquid crystal display device. As shown in FIG. 1, the liquid crystal display device includes a display module 100, a drive module 200 and a backlight module 300. The display module 100 includes a plurality of pixel units 110 arranged in an array, and the pixel unit 110 includes a red sub-pixel 111, a green sub-pixel 112 and a blue sub-pixel 113. The backlight module 300 includes a power supply processing unit 310 and backlight unit 320. The display module 100 is configured to display graphics and text information. The drive module 200 is configured to receive, processing and outputting driving data to control the display module 100 to work properly. The backlight module 300 is configured to process current and turning on the backlight unit 320.

The drive module 200 includes a gray-scale data decomposition processing unit 210. The gray-scale data decomposition processing unit 210 is configured to decompose the original gray-scale data group to be displayed into a first gray-scale data group and a second gray-scale data group, and outputting gray-scale values corresponding to the first gray-scale data group and the second gray-scale data group respectively in two consecutive time periods. The first gray-scale data group is a ternary mixed color gray-scale data group, a binary mixed color gray-scale data group or a unitary color gray-scale data group. The second gray-scale data group is a binary mixed color gray-scale data group or a unitary color gray-scale data group.

The backlight module 300 is provided with a plurality of RGB type backlight units 320. The backlight unit 320 includes a red light source, a green light source and a blue light source, and the color of each light source can be controlled to be ON or OFF independently and meanwhile the bright can be controlled independently. For example, a plurality of RGB type backlight units are used for the backlight units 320. The plurality of RGB type backlight units mutually independent are used as the backlight units 320 disposed on the backlight module 300, each RGB backlight unit and the color thereof can be controlled to be ON or OFF independently, and meanwhile the bright can be controlled independently.

The display module 100 is divided into at least two display areas mutually independent. For each color image-text, the color basically the same or changes a little in one small area, with the same dominant color and the minimum gray-scale is generally the same or mostly the same; in such case, after the gray-scale data decomposition, all or most of the decomposed gray-scale data groups of the pixel units in the area include zero gray-scale data, which totally or mostly correspond to the same color; in such case, when the decomposed gray-scale data groups are displayed, the light of the backlight units having the same color as that of the zero gray-scale data does not work, and theses backlight units can be turned off for saving energy. That is, by dividing the display module, the backlight units 320 in the small area can be distributed on demands to achieve energy saving.

The display area corresponds to at least one backlight unit, and the backlight units corresponding to the different display areas are mutually independent. Since liquid crystal per se is not a light emitting object but a photoresist switch, each liquid crystal cell should have a corresponding external light source, and no adverse effect should be brought to other display areas if the external light source corresponding to each display area is turned off. Therefore, it is necessary for each display area to at least correspond to one backlight unit, and the backlight units corresponding to the different display areas should be mutually independent.

The gray-scale data decomposition processing unit 210 is connected to all of the red sub-pixels 111, the green sub-pixels 112 and the blue sub-pixels 113 in the display module 100 for decomposing input original gray-scale data corresponding to the each pixel unit 110 into two new gray-scale data groups, and outputting gray-scale values of the red sub-pixels 111, the green sub-pixels 112 and the blue sub-pixels 113 in each pixel unit 110 in two consecutive time periods.

The drive module 200 further includes a driving frequency adjusting unit 220. The driving frequency adjusting unit 220 is configured to adjust the driving frequency. An original gray-scale value is decomposed into two gray-scale values to be displayed in two consecutive time periods, so that the display time of an image is doubled. That is, the display speed is reduced by half, and the driving frequency can be increased to compensate for the display speed decreased due to the decomposition of the gray-scale value. The driving frequency can be increased by means of adding hardware, or changing a software driver, or simultaneously changing the hardware and a software program.

The drive module 210 further includes a backlight adjusting unit 230. The backlight adjusting unit 230 is configured to adjust the color and brightness of the backlight unit. To turn off the backlight unit 320 corresponding to the zero gray-scale value for achieving the energy saving effect of this application, a plurality of backlight units mutually independent are used in this application to serve as the sources of the backlight units 320. Moreover, the light sources of three colors of each backlight unit are controlled independently, and switches for the light sources of all the colors in each backlight unit can be adjusted independently. In addition, the process of decomposing the gray-scale value is to decompose the original high gray-scale value into two new low gray-scale values. That is, actually, a set of high-voltage signals is decomposed into two sets of low-voltage signal, so that the brightness is decreased. To compensate for the brightness decreased due to the decomposition of the gray-scale value, the backlight brightness corresponding to the non-0 gray-scale value can be increased, that is, increasing the backlight intensity to compensate for the brightness decreased due to the decomposition of the gray-scale value. The brightness of the backlight unit 320 can be increased by means of changing hardware, and/or changing a software driver.

In one embodiment, the display module is divided into a plurality of mutually independent display areas; a backlight panel is provided with at least one backlight unit corresponding to each display area; and the backlight unit includes a red light source, a green light source and a blue light source. The energy saving effect can be achieved by turning off all or substantially all the light sources of the color corresponding to the zero gray-scale data in a display area. In addition, by changing the driving frequency of the drive module and the backlight brightness of the backlight module, the display device can be adapted to the display of the decomposed data, and alleviate the color shift at the large viewing angle without reducing the original visual effect of the image.

Any "backlight unit 320" above can control the light emitting and ON/OFF state of the red, green and blue light sources individually and independently. For example, the "light emitting unit" disclosed can adjust the brightness and ON/OFF of any one of the red, green and blue light individually. The brightness, mixing ratio and ON/OFF of any two or three of the red, green and blue light can also be controlled.

In one embodiment, the backlight unit 320 may be any light emitting unit capable of emitting red, green and blue light individually, which will not be defined here. For example, the light emitting unit in the disclosure may be an RGB type LED light or the like.

Technical features in the foregoing embodiments may be combined randomly. For the brevity of description, not all possible combinations of various technical features in the foregoing embodiments are described. However, as long as combinations of these technical features do not contradict each other, it should be considered that the combinations all fall within the scope of this specification.

The foregoing embodiments only show several implementations of this application and are described in detail, but they should not be construed as a limit to the patent scope of this application. It should be noted that, a person of ordinary skill in the art may make various changes and improvements without departing from the ideas of this application, which shall all fall within the protection scope of this application. Therefore, the protection scope of the patent of this application shall be subject to the appended claims.

The invention claimed is:

1. A driving method for a liquid crystal display device, wherein the liquid crystal display device comprises a display module and a backlight module; the display module comprises a plurality of pixel units arranged in an array; the pixel unit comprises a red sub-pixel, a green sub-pixel and a blue sub-pixel; the pixel unit generates a color of any one of the following three types: a unitary color, a binary mixed color and a ternary mixed color each time; the backlight module is provided with a plurality of backlight units; the backlight units comprise a red light source, a green light source and a blue light source; the display module is divided into at least two display areas mutually independent; the display area corresponds to at least one of the backlight units, and the backlight units corresponding to different display areas are mutually independent, wherein the driving method comprises:

dividing an original gray-scale data group corresponding to each pixel unit into a first gray-scale data group, a second gray-scale data group and a third gray-scale data group according to a set grouping rule;

outputting and displaying the first gray-scale data group, the second gray-scale data group and the third gray-scale data group in three consecutive time periods respectively;

the first gray-scale data group being a ternary mixed color gray-scale data group, a binary mixed color gray-scale data group or a unitary color gray-scale data group;

the second gray-scale data group being a binary mixed color gray-scale data group or a unitary color gray-scale data group; and the third gray-scale data group being a unitary color gray-scale data group;

calculating an average gray-scale value of the red sub-pixels, an average gray-scale value of the green sub-pixels and an average gray-scale value of the blue sub-pixels among gray-scale values corresponding to original gray-scale data to be displayed in each display area respectively;

determining magnitudes of the average gray-scale value of the red sub-pixels, the average gray-scale value of the green sub-pixels and the average gray-scale value of the blue sub-pixels in each display area;

turning off, in a time period in which the second gray-scale data group is displayed, a light source in a backlight unit corresponding to each display area, which light source has a color the same as the color of sub-pixels with a minimum average gray-scale value in the each display area; and turning off, in a time period in which the third gray-scale data group is displayed, a light source in a backlight unit corresponding to each display area, which light source has a color different from that of sub-pixels with a maximum average gray-scale value in the each display area.

2. The driving method for the liquid crystal display device according to claim 1, wherein the driving method further comprises:

increasing a driving frequency for each pixel unit to 1 to 4 times to compensate for a display speed decreased due to decomposition of the gray-scale value.

3. The driving method for the liquid crystal display device according to claim 2, wherein the driving frequency for each pixel unit is increased to 3 times to keep the display speed of the pixel unit after the decomposition of the gray-scale value the same as the display speed before the decomposition of the gray-scale value.

4. The driving method for the liquid crystal display device according to claim 2, wherein the driving method further comprises:

increasing brightness of a color light source controlled to be in ON state in the backlight unit to 1 to 4 times to compensate for display brightness decreased due to the decomposition of the gray-scale value, or the increase of the driving frequency, or the combined action of the decomposition of the gray-scale value and the increase of the driving frequency.

5. The driving method for the liquid crystal display device according to claim 4, wherein the brightness of the color light source controlled to be in ON state in the backlight unit is increased to 3 times to keep the brightness of the pixel unit after the decomposition of the gray-scale value the same as the brightness before the decomposition of the gray-scale value.

6. The driving method for the liquid crystal display device according to claim 1, wherein the dividing the original gray-scale data group corresponding to each pixel unit into the first gray-scale data group, the second gray-scale data group and the third gray-scale data group according to the set grouping rule comprises:

determining a type of a color corresponding to the original gray-scale data group of the pixel unit; and dividing, based on the type of the color corresponding to the original gray-scale data group of the pixel unit, the original gray-scale data group into the first gray-scale data group, the second gray-scale data group and the third gray-scale data group according to the set grouping rule.

7. The driving method for the liquid crystal display device according to claim 6, wherein the determining the type of the color corresponding to the original gray-scale data group of the pixel unit comprises:

determining a type of a color corresponding to the original gray-scale data according to the number of zero gray-scale data in the original gray-scale data group of the pixel unit;

determining that a color corresponding to the original gray-scale data group is the ternary mixed color when the original gray-scale data group comprises no zero gray-scale data;

determining that a color corresponding to the original gray-scale data group is the binary mixed color when the original gray-scale data group comprises one piece of zero gray-scale data; and determining that a color corresponding to the original gray-scale data group is the unitary color when the original gray-scale data group comprises two pieces of zero gray-scale data.

8. The driving method for the liquid crystal display device according to claim 1, wherein a grouping rule corresponding to the ternary mixed color gray-scale data comprises:

taking minimum original gray-scale data in the original gray-scale data group corresponding to the pixel unit of the ternary mixed color as common gray-scale data for the red sub-pixel, the green sub-pixel and the blue sub-pixel in the pixel unit to constitute the first gray-scale data group;

taking minimum non-0 gray-scale data in a difference data group obtained by subtracting the first gray-scale data group from the original gray-scale data group corresponding to the pixel unit of the ternary mixed color as common gray-scale data for the sub-pixels corresponding to the non-0 gray-scale data in the difference data group, to constitute the second gray-scale data group together with the zero gray-scale data; and taking a difference data group obtained by subtracting the first gray-scale data group and the second gray-scale data group from the original gray-scale data group corresponding to the pixel unit of the ternary mixed color as the third gray-scale data group.

9. The driving method for the liquid crystal display device according to claim 1, wherein a grouping rule corresponding to the binary mixed color gray-scale data comprises:

taking gray-scale data corresponding to half of gray-scale values corresponding to minimum non-0 gray-scale data in the original gray-scale data group corresponding to the pixel unit of the binary mixed color as common gray-scale data for the sub-pixels corresponding to two pieces of non-0 gray-scale data in the pixel unit, to constitute the first gray-scale data group and the second gray-scale data group respectively together with the zero gray-scale data; and taking a difference data group obtained by subtracting the first gray-scale data group and the second gray-scale data group from the original gray-scale data group corresponding to the pixel unit of the binary mixed color as the third gray-scale data group.

10. The driving method for the liquid crystal display device according to claim 1, wherein a grouping rule corresponding to the unitary color gray-scale data comprises:

taking gray-scale data corresponding to one third of a gray-scale value corresponding to the non-0 gray-scale data in the original gray-scale data group corresponding to the pixel unit of the unitary color as gray-scale data of the sub-pixel corresponding to the non-0 gray-scale data in the pixel unit, to constitute the first gray-scale data group, the second gray-scale data group and the third gray-scale data group together with the zero gray-scale data respectively.

11. A driving method for a liquid crystal display device, wherein the liquid crystal display device comprises a display module and a backlight module; the display module comprises a plurality of pixel units arranged in an array, and the pixel unit comprise a red sub-pixel, a green sub-pixel and a blue sub-pixel; the pixel unit generates a color of any one of the following three types: a unitary color, a binary mixed color and a ternary mixed color each time; the backlight module is provided with a plurality of backlight units; the backlight unit comprises a red light source, a green light source and a blue light source; the display module is divided into at least two display areas mutually independent; the display area corresponds to at least one of the backlight units, and the backlight units corresponding to different display areas are mutually independent, the driving method comprising:

dividing an original gray-scale data group corresponding to $n^{th}$ pixel unit into a first gray-scale data group, a second gray-scale data group and a third gray-scale data group according to a set grouping rule;

outputting and displaying the first gray-scale data group, the second gray-scale data group and the third gray-scale data group in three consecutive time periods respectively;

the first gray-scale data group being a ternary mixed color gray-scale data group, a binary mixed color gray-scale data group or a unitary color gray-scale data group;

the second gray-scale data group being a binary mixed color gray-scale data group or a unitary color gray-scale data group;

the third gray-scale data group being a unitary color gray-scale data group;

calculating an average gray-scale value of the red sub-pixels, an average gray-scale value of the green sub-pixels and an average gray-scale value of the blue sub-pixels among gray-scale values corresponding to original gray-scale data to be displayed in a $N^{th}$ display area;

determining magnitudes of the average gray-scale value of the red sub-pixels, the average gray-scale value of the green sub-pixels and the average gray-scale value of the blue sub-pixels in the $N^{th}$ display area;

turning off a light source in the backlight unit corresponding to the $N^{th}$ display area, which light source has a color the same as the color of the sub-pixels with the minimum average gray-scale value in the $N^{th}$ display area, in a time period in which the second gray-scale data group is displayed;

turning off a light source in the backlight unit corresponding to the $N^{th}$ display area, which light source has a color different from the color of the sub-pixels with the maximum average gray-scale value in the $N^{th}$ display area, in a time period in which the third gray-scale data group is displayed; and both n and N are integers greater than or equal to 1.

12. The driving method for the liquid crystal display device according to claim 11, wherein the driving method further comprises:

determining a type of a color corresponding to the original gray-scale data according to the number of zero gray-scale data in the original gray-scale data group to be displayed in the $n^{th}$ pixel unit;

determining that a color corresponding to the original gray-scale data group is the ternary mixed color when the original gray-scale data group comprises no zero gray-scale data;

determining that a color corresponding to the original gray-scale data group is the binary mixed color when the original gray-scale data group only comprises one piece of zero gray-scale data; and determining that a color corresponding to the original gray-scale data group is the unitary color when the original gray-scale data group only comprises two pieces of zero gray-scale data.

13. The driving method for the liquid crystal display device according to claim 11, wherein the driving method further comprises:

increasing a driving frequency for each pixel unit to 1 to 4 times to compensate for a display speed decreased due to decomposition of the gray-scale value.

14. The driving method for the liquid crystal display device according to claim 11, wherein the driving method further comprises:

increasing brightness of a color light source controlled to be in ON state in the backlight unit to 1 to 4 times to compensate for display brightness decreased due to the decomposition of the gray-scale value, or the increase of the driving frequency, or the combined action of the decomposition of the gray-scale value and the increase of the driving frequency.

15. The driving method for the liquid crystal display device according to claim 11, wherein a grouping rule corresponding to the ternary mixed color gray-scale data comprises:

taking minimum original gray-scale data in the original gray-scale data group corresponding to the pixel unit of the ternary mixed color as common gray-scale data for the red sub-pixel, the green sub-pixel and blue sub-pixel in the pixel unit, to constitute the first gray-scale data group;

taking minimum non-0 gray-scale data in a difference data group obtained by subtracting the first gray-scale data group from the original gray-scale data group corresponding to the pixel unit of the ternary mixed color as common gray-scale data for the sub-pixels corresponding to the non-0 gray-scale data in the difference data group, to constitute the second gray-scale data group together with the zero gray-scale data; and taking a difference data group obtained by subtracting the first gray-scale data group and the second gray-scale data group from the original gray-scale data group corresponding to the pixel unit of the ternary mixed color as the third gray-scale data group.

16. The driving method for the liquid crystal display device according to claim 11, wherein a grouping rule corresponding to the binary mixed color gray-scale data comprises:

taking gray-scale data corresponding to half of gray-scale values corresponding to minimum non-0 gray-scale data in the original gray-scale data group corresponding to the pixel unit of the binary mixed color as common gray-scale data for the sub-pixels corresponding to two pieces of non-0 gray-scale data in the pixel unit, to constitute the first gray-scale data group and the second gray-scale data group together with the zero gray-scale data respectively; and taking a difference data group obtained by subtracting the first gray-scale data group and the second gray-scale data group from the original gray-scale data group corresponding to the pixel unit of the binary mixed color as the third gray-scale data group.

17. The driving method for the liquid crystal display device according to claim 11, wherein a grouping rule corresponding to the unitary color gray-scale data comprises:

taking gray-scale data corresponding to one third of gray-scale values corresponding to the non-0 gray-scale data in the original gray-scale data group corresponding to the pixel unit of the unitary color as gray-scale data of the sub-pixel corresponding to the non-0 gray-scale data in the pixel unit, to constitute the first gray-scale data group, the second gray-scale data group and the third gray-scale data group together with the zero gray-scale data respectively.

18. A driving method for a liquid crystal display device, wherein the liquid crystal display device comprises a display module and a backlight module; the display module comprises a plurality of pixel units arranged in an array, and the pixel unit comprises a red sub-pixel, a green sub-pixel and a blue sub-pixel; the pixel unit generates a color of any one of the following three types: a unitary color, a binary mixed color and a ternary mixed color each time; the backlight module is provided with a plurality of backlight units; the backlight unit comprises a red light source, a green light source and a blue light source; the display module is divided into at least two display areas mutually independent; the display area corresponds to at least one of the backlight units, and the backlight units corresponding to different display areas are mutually independent, the driving method comprising:

calculating an average gray-scale value of the red sub-pixels, an average gray-scale value of the green sub-pixels and an average gray-scale value of the blue sub-pixels among gray-scale values corresponding to original gray-scale data to be displayed in each display area;

determining magnitudes of the average gray-scale value of the red sub-pixels, the average gray-scale value of the green sub-pixels and the average gray-scale value of the blue sub-pixels in each display area; and determining whether number of the pixel units displaying the unitary color in the display area reaches a first set value, and if yes, turning off a light source in the backlight unit corresponding to the display area, which light source has a color different from the color of the sub-pixels with the maximum average gray-scale value in the display area.

19. The driving method for the liquid crystal display device according to claim 18, wherein the driving method further comprises:

determining whether a pixel block in which the number of the pixel units displaying the unitary color reaches a second set value exists in the display area, and if yes, maintaining the light source in the backlight unit corresponding to the display area, which light source has a color different from the color of the sub-pixels with the maximum average gray-scale value in the display area, to be turned on; otherwise, turning off the light source in the backlight unit corresponding to the display area, which light source has a color different from the color of the sub-pixels with the maximum average gray-scale value in the display area.

20. The driving method for the liquid crystal display device according to claim 18, wherein the driving method further comprises:

determining whether the number of the pixel units displaying the binary mixed color in the display area reaches a third set value, and if yes, turning off a light source in the backlight unit corresponding to the display area, which light source has a color the same as the color of the sub-pixels with the minimum average gray-scale value in the display area.

* * * * *